US008230665B2

(12) United States Patent
Pugh et al.

(10) Patent No.: US 8,230,665 B2
(45) Date of Patent: Jul. 31, 2012

(54) APPARATUS AND METHODS FOR PRODUCING EMBOSSED PROMOTIONAL CARDS

(76) Inventors: Jeffrey D. Pugh, Plymouth, MN (US); Jason L. Hedlund, Plymouth, MN (US)

( * ) Notice: Subject to any disclaimer, the term of this patent is extended or adjusted under 35 U.S.C. 154(b) by 215 days.

(21) Appl. No.: 12/300,596

(22) PCT Filed: May 11, 2007

(86) PCT No.: PCT/US2007/068798

§ 371 (c)(1),
(2), (4) Date: Apr. 23, 2009

(87) PCT Pub. No.: WO2007/134243

PCT Pub. Date: Nov. 22, 2007

(65) Prior Publication Data

US 2009/0309254 A1 Dec. 17, 2009

Related U.S. Application Data

(60) Provisional application No. 60/747,431, filed on May 17, 2006, provisional application No. 60/799,852, filed on May 12, 2006.

(51) Int. Cl.
*B65B 35/50* (2006.01)

(52) U.S. Cl. ..... 53/447; 53/435; 156/209

(58) Field of Classification Search ..... 53/447, 53/435, 520; 264/138, 297.8; 235/494, 380, 235/488; 156/209
See application file for complete search history.

(56) References Cited

U.S. PATENT DOCUMENTS

| | | | | |
|---|---|---|---|---|
| 3,461,581 | A | 8/1969 | Hoffmann | |
| 4,999,075 | A | 3/1991 | Coburn, Jr. | |
| 5,070,781 | A | 12/1991 | Lundstrom et al. | |
| 5,191,435 | A * | 3/1993 | Tsunekawa et al. | 386/224 |
| 5,503,514 | A | 4/1996 | LaManna et al. | |
| 5,579,117 | A * | 11/1996 | Arsenault et al. | 358/296 |
| 5,837,991 | A | 11/1998 | LaManna et al. | |
| 6,142,370 | A | 11/2000 | LaManna et al. | |
| 6,467,687 | B1 | 10/2002 | Hill et al. | |
| 6,471,128 | B1 | 10/2002 | Corcoran et al. | |
| 6,676,587 | B2 | 1/2004 | Smith et al. | |
| 6,688,529 | B1 * | 2/2004 | Goade, Sr. | 235/488 |
| 7,029,547 | B2 | 4/2006 | Biller | |
| 7,384,003 | B1 | 6/2008 | Boyer et al. | |
| 7,429,036 | B2 * | 9/2008 | McGrane | 270/1.01 |
| 7,461,791 | B2 * | 12/2008 | Keshura | 235/488 |
| 2002/0152001 | A1 | 10/2002 | Knipp et al. | |
| 2003/0050163 | A1 | 3/2003 | Smith | |
| 2004/0123748 | A1 | 7/2004 | Bayer et al. | |
| 2004/0144472 | A1 * | 7/2004 | Cowie | 156/64 |
| 2004/0149097 | A1 | 8/2004 | Bayer et al. | |

(Continued)

FOREIGN PATENT DOCUMENTS

| | | |
|---|---|---|
| WO | WO0169521 | 9/2001 |

(Continued)

*Primary Examiner* — Thanh Truong
(74) *Attorney, Agent, or Firm* — Larkin Hoffman Daly & Lindgreen Ltd.; Thomas J. Oppold

(57) ABSTRACT

Apparatus and methods of producing embossed promotional cards which minimize nesting of adjacently embossed cards in a stack, the apparatus and method provide for offsetting the embossed indicia between adjacently stacked cards or for varying the embossed indicia between adjacently stacked cards.

3 Claims, 9 Drawing Sheets

U.S. PATENT DOCUMENTS

2005/0000842 A1* 1/2005 Timmerman et al. ..... 206/449
2005/0028922 A1* 2/2005 Biller ..... 156/219
2005/0067497 A1* 3/2005 Jones et al. ..... 235/492
2005/0257880 A1 11/2005 Herring et al.
2005/0279447 A1 12/2005 Lebrun et al.
2006/0027109 A1 2/2006 Criss
2006/0065033 A1 3/2006 Spirito et al.

FOREIGN PATENT DOCUMENTS

WO WO2005113256 12/2005

* cited by examiner

APPARATUS AND METHODS FOR PRODUCING EMBOSSED PROMOTIONAL CARDS

CROSS-REFERENCE TO RELATED APPLICATIONS

This application claims priority to U.S. Provisional Application No. 60/799,852 filed May 12, 2006, which is incorporated herein in its entirety by reference and to U.S. Provisional Application No. 60/747,431 filed May 17, 2006, which is also incorporated herein in its entirety by reference.

BACKGROUND

Recently, issuers of credit cards, bank cards, merchant cards, etc. (collectively, "credit cards") have begun to enclose "promotional cards" along with their application forms and other promotional literature as part of their mass mailing solicitations to potential consumers. The promotional cards are typically made to appear like an actual credit card of the card issuer in that the promotional cards often include the same color scheme, graphics and logos of both the issuer and the credit card brand (i.e. Visa, Mastercard, Discover, etc.). In addition, the promotional cards generally include embossed numbers in the same format as the embossed account number of an actual issued credit card. Thus, other than being made from thinner or different material, the promotional cards appear very similar to actual credit cards.

The current practice of making promotional cards involves first printing an array (such as, for example, eight rows and eight columns) of identical card images containing the desired color scheme, graphics, logos, and other information onto a large sheet of substrate material. The substrate material may be polyvinyl chloride (PVC), card stock, nylon, plastic or any other suitable material. The printed sheet containing the array of card images is hereinafter referred to as the "printed card sheet". The printed card sheet may receive further processing such as the addition of a clear protective coat, the addition of metallic foil, or other treatments. Once printed, and after any other desired processing is completed, the printed card sheet is ready for embossing with simulated account numbers as previously discussed to further create the appearance of an actual credit card.

The embossing process involves placing the printed card sheet in an embossing press, the embossing press comprises a male embossing die and female counter-embossing die, each male and female die has an array of embossing numbers corresponding to the desired simulated account number to be embossed on each promotional card. On the male die, the embossing numbers are raised. On the female die, the embossing numbers are recessed. In operation, the male and female die are pressed together with the printed card sheet disposed in between. The male die forces the substrate to deform into the female die, resulting in an array of raised or embossed numbers in the printed card sheet (now hereinafter referred to as an "embossed sheet").

After the embossing operation is completed, the embossed sheet is fed into a die cutter having cutting dies with a matching array of rows and columns to stamp or cut out the individual embossed promotional cards. The individual embossed promotional cards are removed from the remainder of sheet and then stacked for further processing.

As recognized in U.S. Pat. No. 7,029,547 (the '547 patent), which is incorporated herein by reference, after the embossed promotional cards are stacked into a hopper or card holder for further processing (such as for gluing the card to a carrier prior to packaging), adjacent cards in the stack often become interlocked as a result of the projecting embossed numbers nesting with the recessed numbers of the adjacent embossed promotional card. Once the cards become nested, it is difficult for the cards to be separated by automated feeding mechanisms for subsequent processing. As suggested by the '547 patent, one way to minimize the nesting of adjacent embossed cards is to offset the embossing in adjacent columns of the printed sheet (See FIG. 1), and then, after cutting the individual embossed cards from the remainder of the sheet, collating the individual cards such that each successive card in the stack has embossing that is offset from the previous card in the stack. While offsetting the embossing may serve the intended purpose of avoiding nesting of adjacent stacked cards, there remains a need for an improved method of producing embossed promotional cards which minimizes the nesting problem identified above but which does not require the offsetting of embossing between adjacent columns of the embossing die. There is also a need for a more efficient method of collating the embossed cards than that disclosed in the '547 patent.

DETAILED DESCRIPTION

Figure 1:
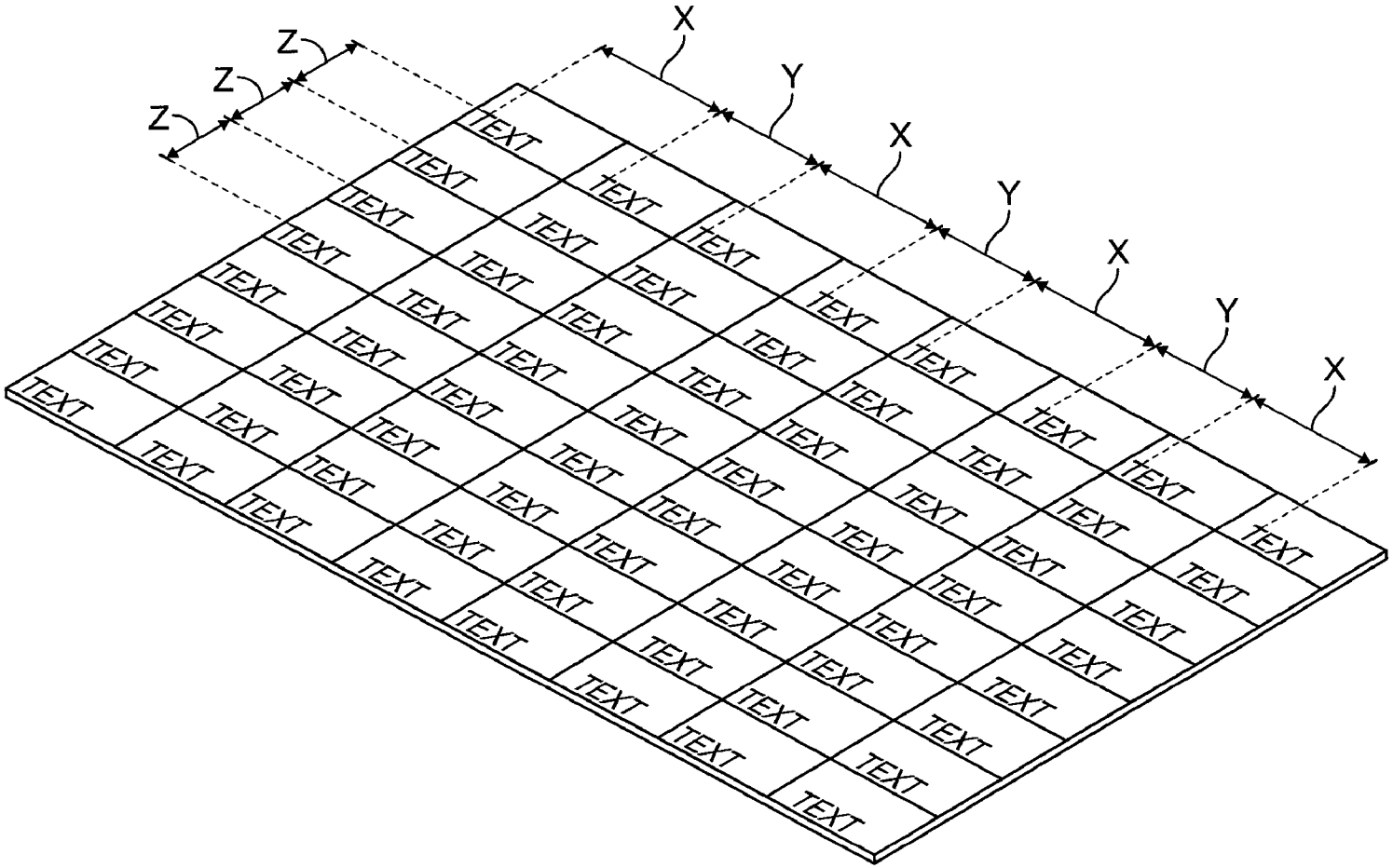
FIG. 1 (Prior Art)
FIG. 1 illustrates a perspective view of a prior art embossed sheet wherein the distance between adjacent columns is different or offset.
Figure 2:
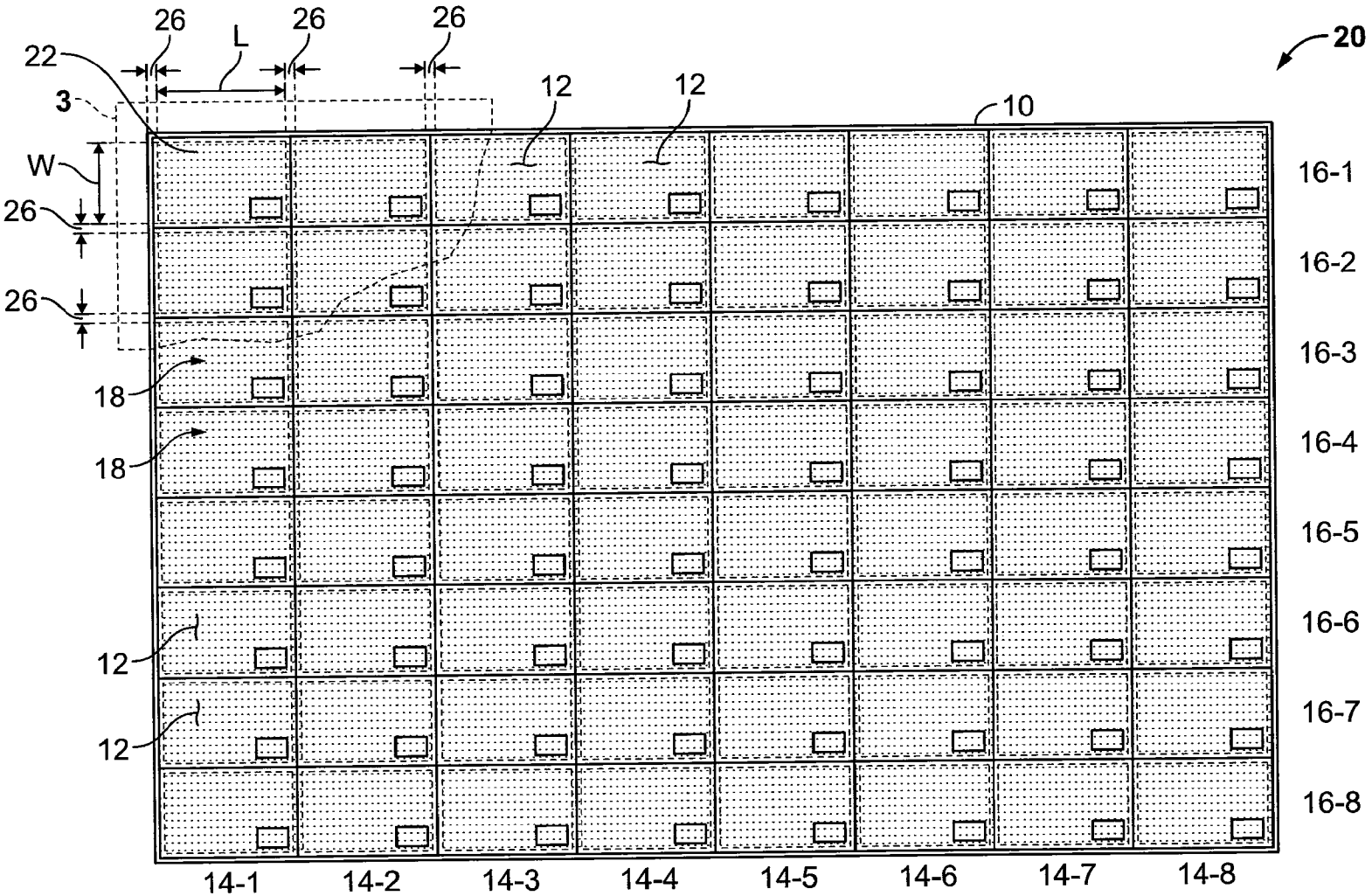
FIG. 2 is a plan view of a printed card sheet wherein the print gutters are uniform between adjacent columns.

Referring to the drawings wherein like reference numerals designate identical or corresponding parts or features throughout the several views, FIG. 2 illustrates a sheet of substrate material designated generally by reference numeral 10, such as polyvinyl chloride (PVC), card stock, nylon, plastic or any other suitable material. Printed upon the sheet 10 of substrate material is an array of graphics 12 arranged in a predetermined number of columns 14 and rows 16 from which the promotional card 18 will be cut (discussed later). The sheet that is printed with the array of graphics 12 is hereinafter referred to as the "printed sheet" which is designated generally by reference numeral 20 (FIG. 2). In the embodiment of the printed sheet 20 of FIG. 2, the array of graphics 12 is shown as comprising eight columns (14-1 through 14-8) and eight rows (16-1 through 16-8). Of course, it should be appreciated that the numbers of columns 14 and rows 16 comprising the array of graphics may vary as desired. As used herein, the term graphics or graphics array 12 should be understood to include photos, artwork, text, logos, colors or color combinations, or any other design or image which makes up the image on the promotional card 18, i.e., the card image.

Each card image comprising the graphics array 12 is defined by a print area 22 (designated by dotted hatching) having a predetermined length "L" and a predetermined width "W." The print area 22 is larger than the desired dimensions of the final promotional card 18 (designated by dashed lines 24 in FIG. 3) to be cut from the print area 22 during the die cutting operation (discussed later). In the preferred embodiment, the dimensions of the promotional cards 18 are preferably substantially the same as the length and width of an actual credit card as defined by ISO 7810 ID-1 (i.e., 3⅜ inch×2⅛ inch or 85.60 mm×53.98 mm). However, it should be understood that the promotional card 18 may be sized as desired.

Figure 3:
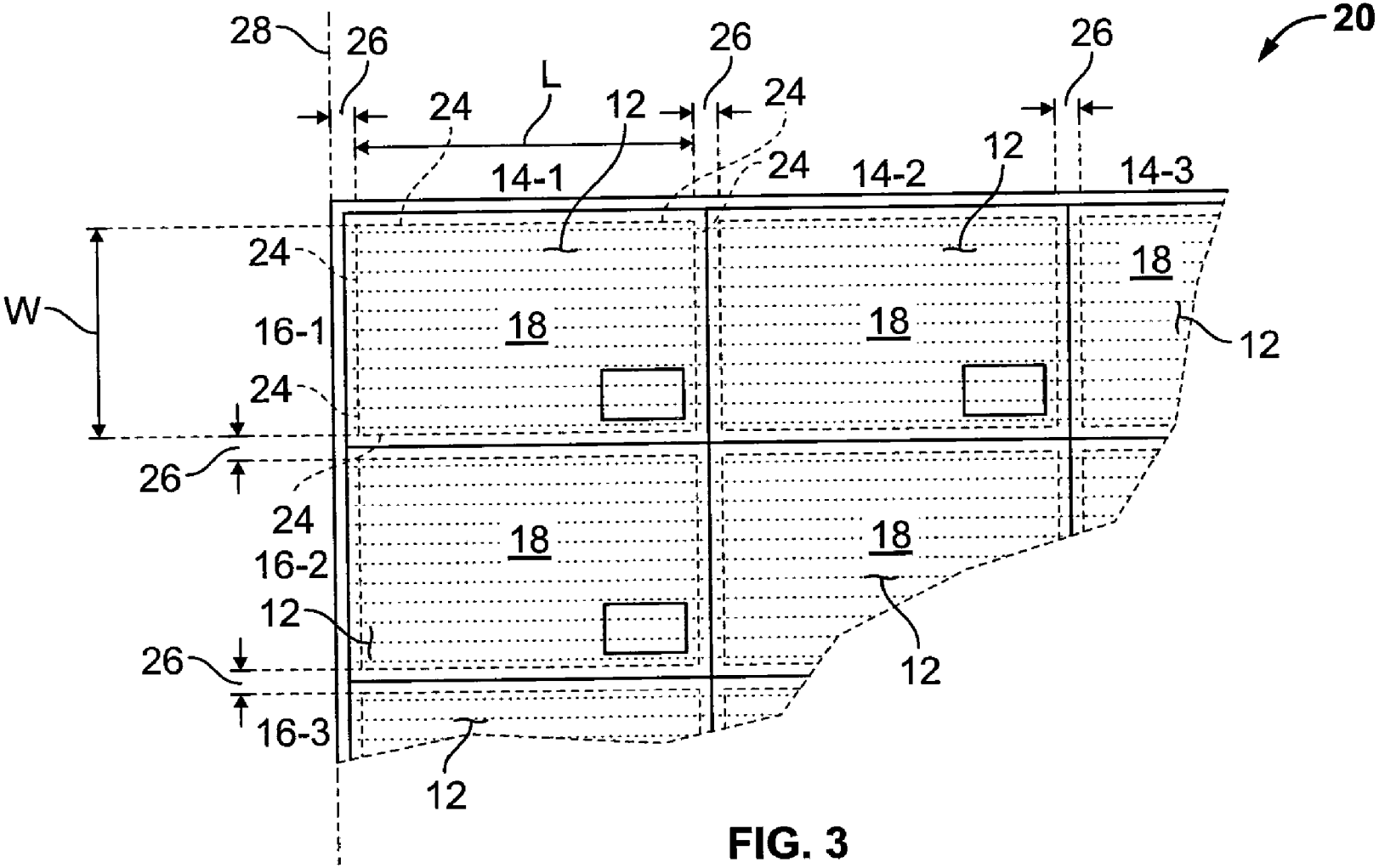
FIG. 3 is a detailed view of a portion of the printed card sheet of FIG. 2.

Continuing to refer to FIG. 3, a gutter 26 overlaps each print area 22. The gutter 26 provides the necessary tolerance between adjacent promotional cards 18 to be cut from the print area 22 during the die cutting operation. In the embodiment illustrated in FIGS. 2 and 3, the gutter 26 is shown as being a substantially fixed or uniform width between adjacent columns 14 and adjacent rows 16. For most promotional card applications, the gutter 26 is generally between one eighth inch (⅛ inch) and one quarter inch (¼ inch) depending on the substrate material. The printed sheet of FIGS. 2 and 3 is shown with a ¼ inch gutter.

Printing the array of graphics 12 on the sheet 10 is generally performed using a digital printing procedure, but other printing procedures recognizes by those of ordinary skill in the art may also be used. During the printing operation, the orientation of the sheet 10 within the printing machine will generally be designated by identification of the side of the sheet 10 that was abutted against the printing machine's "side guide" and which side of the sheet 10 was the "grip side" (i.e., the side of the sheet that was gripped to remove the sheet from the printing machine). The designation of the "side guide" and "grip side" is referred to in the industry as the "print registry" and is useful for ensuring proper orientation of the printed sheet 20 for all subsequent processing steps during the production of the promotional cards 18. Orienting the printed sheet 20 based upon the print registry during subsequent processing operations (such as during the embossing process or during the die cutting process) is referred to in the industry as "registering the sheet to print," or, more simply, "registering to print." Thus, it should be appreciated that by "registering the sheet to print" during the embossing and die cutting operations, a consistent baseline can be maintained from which to align and orient the embossing die and cutting die. The side guide of the printed sheet 20 is designated by reference numeral 28 (FIG. 3).

Figure 4:
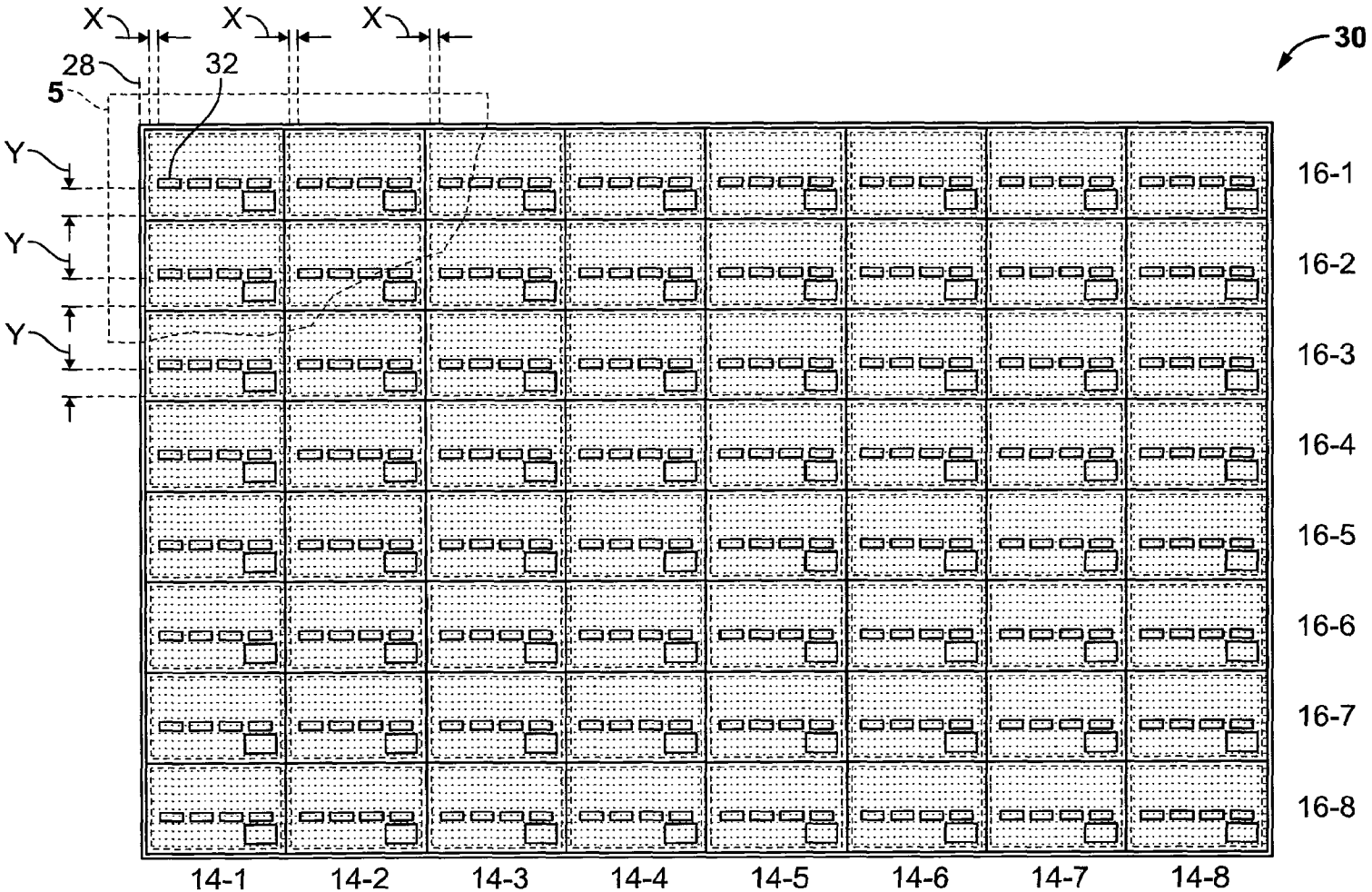
FIG. 4 is a plan view of the embossed sheet created by embossing the printed card sheet of FIG. 2.
Figure 5:
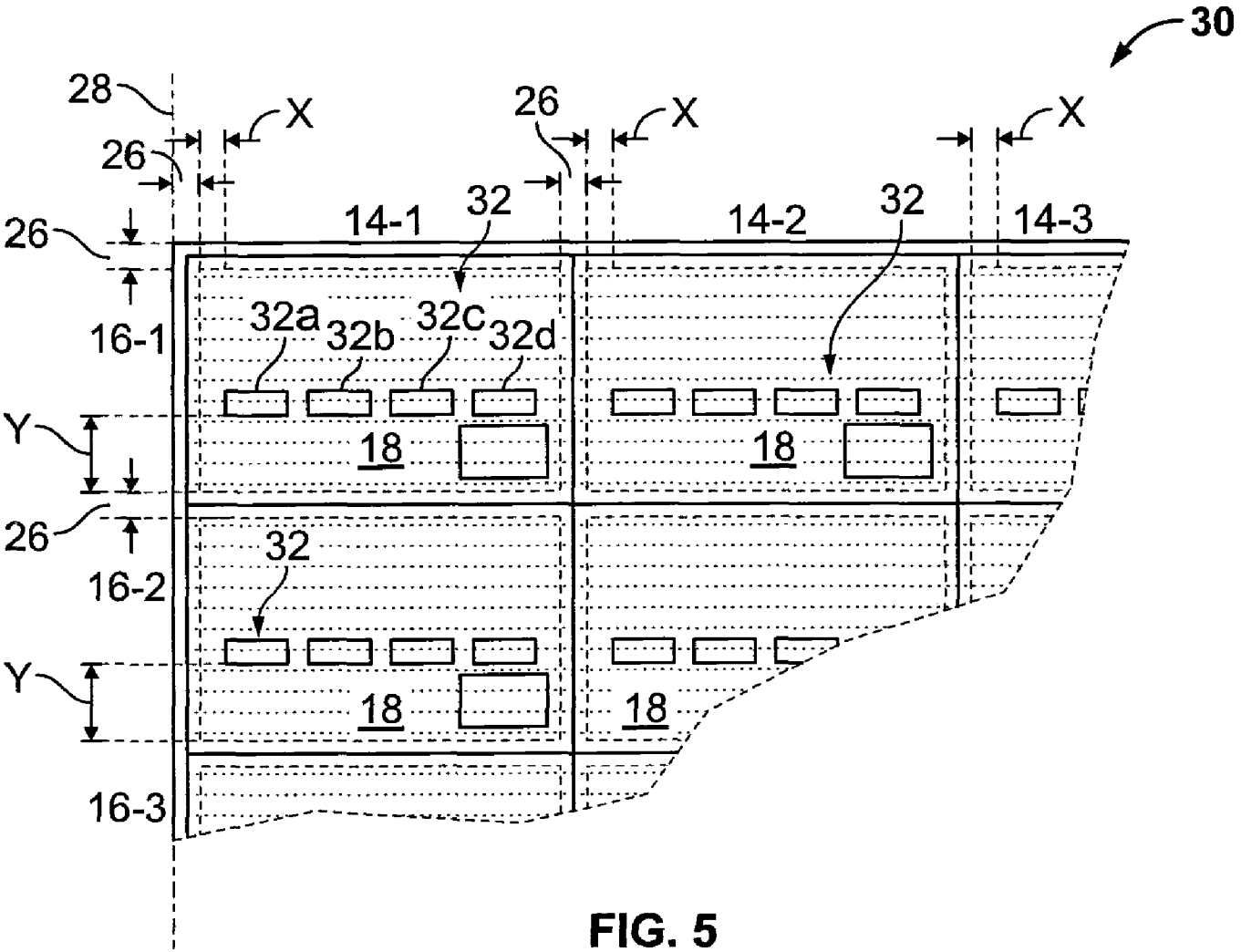
FIG. 5 is a detailed view of a portion of the embossed sheet of FIG. 4.

FIG. 4 is a plan view of an embossed sheet 30 produced by embossing the printed sheet 20 of FIG. 2 with embossed indicia 32. As best illustrated in FIG. 5, in one embodiment, the embossed indicia 32 is shown as comprising four segments (32*a*, 32*b*, 32*c*, 32*d*) similar to the segmented groupings of a typical embossed credit card account number. It should be understood, however, that the present invention should not be construed as being limited to any particular type of embossed indicia 32, nor any particular form or format of alpha numeric or other text or graphic groupings.

In the embodiment of FIGS. 4 and 5, the embossed indicia 32 on each promotional card 18 is shown as beginning at a distance "X" from the side gutter 26. This distance "X" is preferably substantially consistent between each column 14 across the embossed sheet 30. Additionally, the embossed indicia 32 is shown as beginning at a distance "Y" from the bottom gutter 26. The distance "Y" is preferably substantially consistent between each row 16 across the embossed sheet 30.

Figure 6:
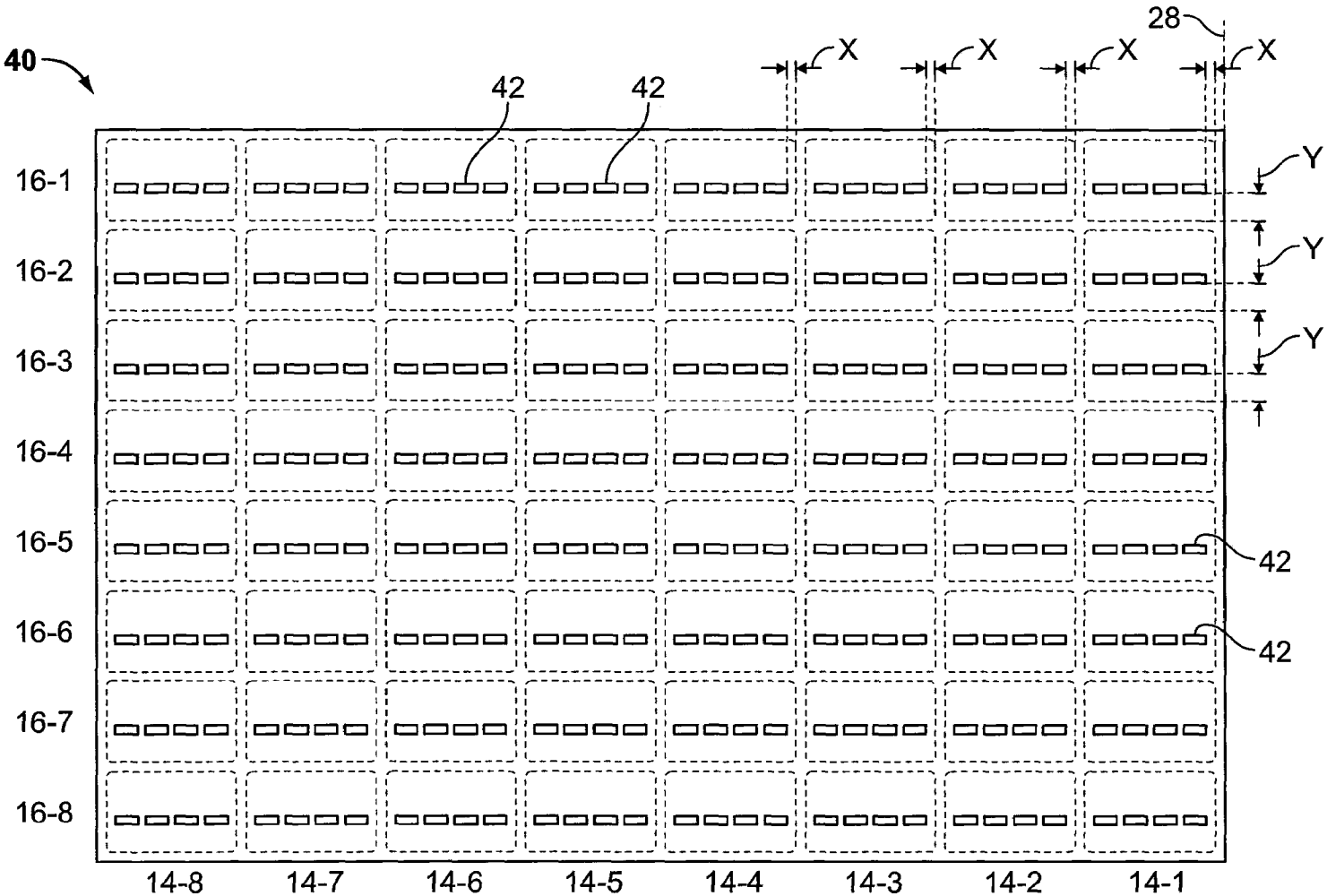
FIG. 6 is a plan view of a female embossing die for producing the embossed sheet of FIG. 4 wherein the embossing indicia is at a uniform distance between adjacent columns.

As previously described, embossing of the printed card sheet 20 is accomplished by placing the printed card sheet in an embossing press (not shown), the embossing press comprises an embossing die comprising a male embossing die and a mating female counter-embossing die. An example of an embodiment of a female counter-embossing die 40 is illustrated in FIG. 6. As shown in FIG. 6, the female die 40 includes an array of embossing indicia 42 which is a mirror image of the embossed sheet of FIG. 4. Furthermore, embossing indicia 42 of the female die is recessed. The male embossing die is a mirror image of the female die 40 except that the array of embossing indicia of the male die is raised instead of recessed.

In operation, the printed card sheet 20 is placed between the male and female embossing dies such that the side guide 28 of the printed card sheet 20 is registered to print with the side guide 28 of the embossing press. The embossing press is actuated causing the male and female die to come together on either side of the printed card sheet 20. The raised embossing indicia of the male die forces the substrate to deform into the mating recessed embossing indicia of the female die, thereby forming the array of embossed indicia 32 on the sheet.

It should be recognized that if all of the cards 18 on the embossed sheet 30 have the same embossed indicia 32, and if the X and Y position from the embossed indicia 32 to the gutter 26 is the same between adjacent columns 14 and adjacent rows 16 of the embossed sheet 30, then nesting will undoubtedly occur if the cards are cut along the print gutter lines 26 and then stacked. Therefore, in order to minimize nesting of adjacent cards when stacked, offsetting the cutting die with respect to the print gutter 26 between adjacent columns 14 will provide an appropriate offset of the embossed indicia 32 if the cards cut from each row 16 are collated prior to stacking.

Figure 7:
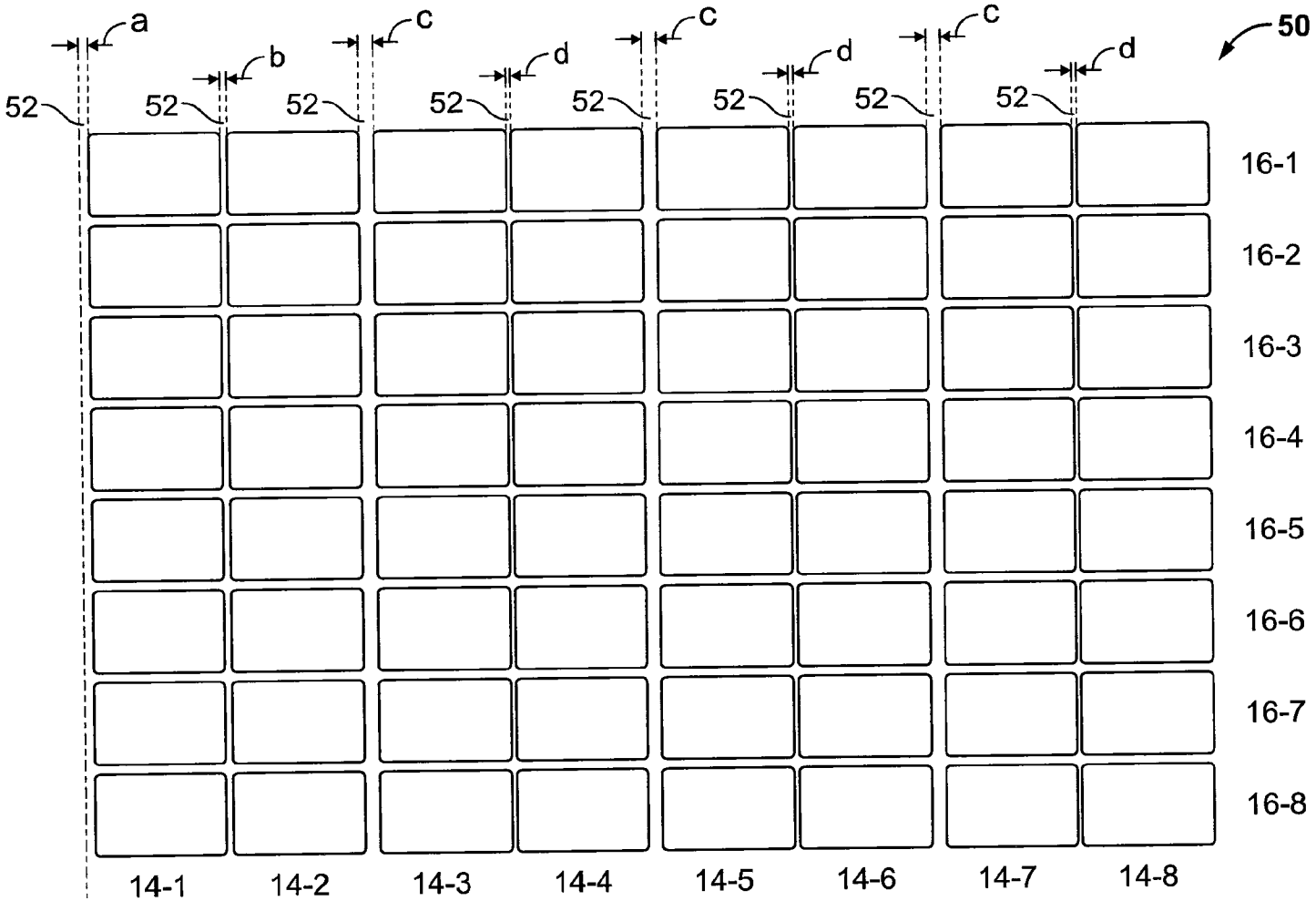
FIG. 7 is plan view of a cutting die for cutting the embossed sheet of FIG. 4, wherein the gutters of the cutting die are shown offset from adjacent columns.

As such, a preferred embodiment of the cutting die 50 is illustrated in FIG. 7, wherein the gutter 52 between adjacent columns 14 of the cutting die 50 varies across the length of the cutting die 50. For example, the cutting die gutters 52 may have dimensions "a", "b", "c" and "d" as illustrated in FIG. 7, wherein gutter "a" may be ¼ inch, gutter "b" may be 3/16 inch, gutter "c" may be ⅜ inch and gutter "d" may be ⅛ inch. It should be understood that the foregoing gutter dimensions are provided by way of example only, and should not be construed as limiting the present invention to any particular gutter dimensions.

After the individual cards 18 are cut from the embossed sheet 30 by the cutting die 50, the cut cards 18 are maintained in their same orientation by the uncut portion between the gutters 26 of the embossed sheet 30. The cut embossed sheet 30 is conveyed into a stripping blanking system (not shown) such as Model No. BSP-40 available from the Brausse Group, 7700 68th Avenue North, Brooklyn Park, Minn. 55428. The foregoing stripping blanking system strips the waste portion of the sheet 30 while maintaining the cut embossed cards 18 in their same relative orientation until being fed into a collator. During the collating process, all of the cut cards 18 are rotated as a unit ninety degrees, whereby the cards, formerly oriented in columns (14-1 through 14-8) with each column having offset embossing, are now oriented such that all of the cards from each of the respective columns are fed through the collator together as a row, followed by all of the cards from the next column and so-on. Thus, for example, with an 8×8 array, a card from the first column 14-1 is followed by a card from the second column 14-2, which is in turn followed by a card from the third column 14-3 and so-on until all of the cards cut from a sheet are stacked in eight separate stacks, with each stack containing eight cards collated in sequential order from the first column 14-1 through the eighth column 14-8. This sequential collation pattern repeats with cards from a subsequent die cut sheet 30 wherein cards from the eighth column 14-8 of a preceding sheet 30 are followed by cards from the first column 14-1 of a subsequent die cut sheet and so-on.

Using the dimensions from the above examples, wherein the printed sheet 20 includes a fixed ¼ inch print gutter 26 (FIG. 2) and wherein the cutting die 50 has varying die cutting gutters 52 of dimensions "a"=¼ inch; "b"=3/16 inch; "c"=⅜ inch and "d"=⅛ inch, as shown in FIG. 7, it should be appreciated that when the cards 18 are collated and stacked as just described, the embossing indicia 32 on the cards from the first column 14-1 are offset from the embossing indicia 32 on the cards from the second column 14-2 by 1/16 inch (i.e., the difference between the fixed ¼ inch print gutter 26 and the 3/16 inch die cutting gutter 52 between the first and second columns). Similarly, it should be appreciated that the cards from the second, fourth, sixth and eighth columns (14-4, 14-6, 14-8) are each offset from the embossing on the third, fifth and seventh columns (14-3, 14-5, 14-7), respectively, by ⅛ inch (i.e., the difference between the fixed ¼ inch print gutter 26 and the ⅜ inch die cutting gutter 52 between the second and third, fourth and fifth, and sixth and seventh columns; or the difference between the fixed ¼ inch print gutter 26 and the ⅛ inch die cutting gutter 52 between the third and fourth, fifth and sixth, and seventh and eighth columns, respectively). As such, with the embossing indicia 32 on each card 18 in each stack offset from the embossing indicia 32 of each immediately adjacent card in the stack, the nesting problem is minimized.

Figure 8:
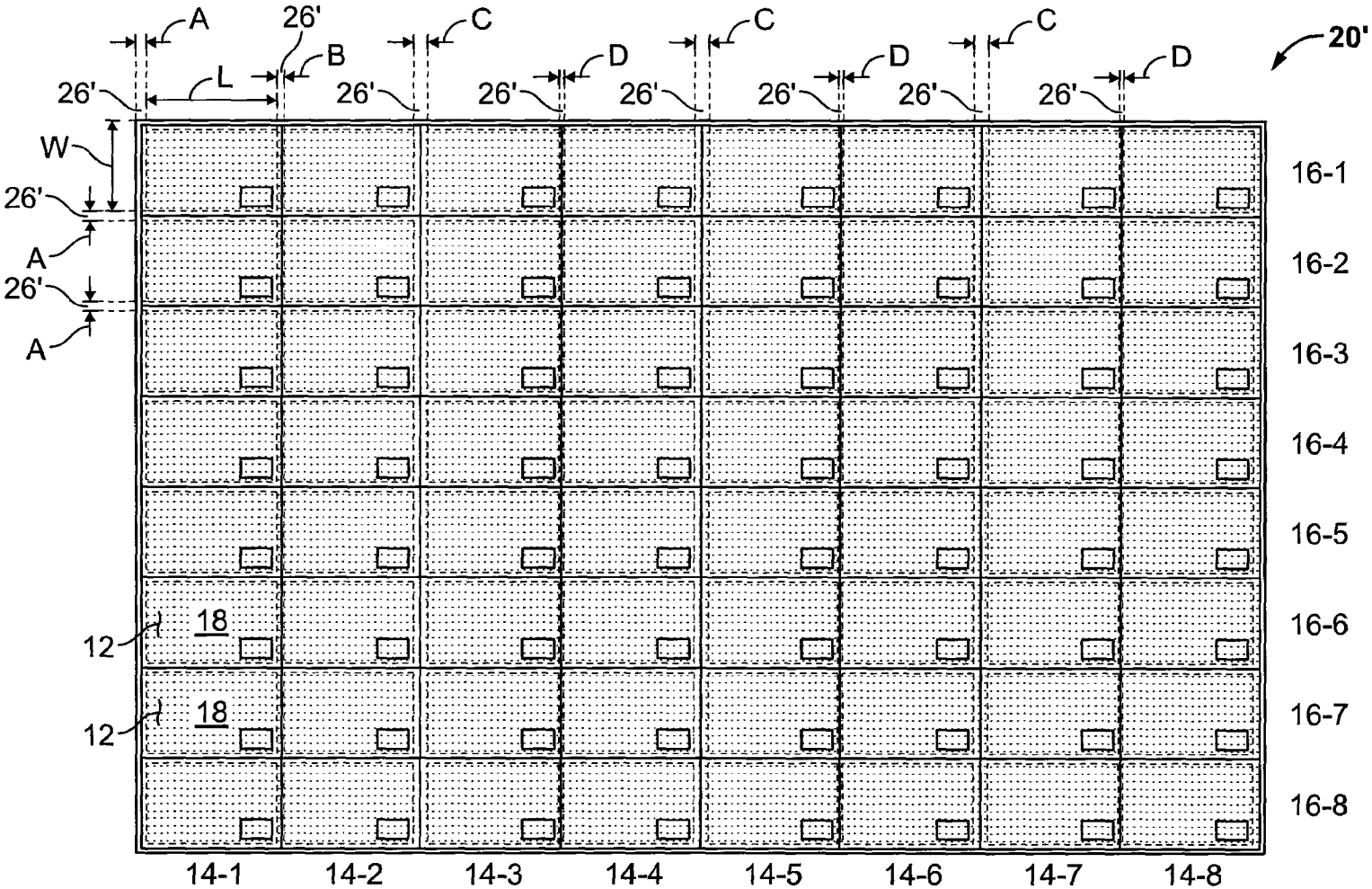
FIG. 8 is a plan view of another embodiment of a printed card sheet wherein the print gutters are shown offset from adjacent columns.

A second alternative method of producing embossed promotional cards is hereinafter described. In this second alternative method, rather than the print sheet 20 having uniform print gutters 26 as in the previous embodiment of FIG. 2, as illustrated in FIG. 8, the print sheet 20' may instead be printed with variable print gutters 26' of dimensions "A", "B", "C" and "D" corresponding to the variable die cutting gutters 52 of FIG. 7 having dimensions "a", "b", "c" and "d". For example, gutter dimensions "a" and "A" may be ¼ inch, gutter dimensions "b" and "B" may be 3/16 inch, gutter dimensions "c" and "C" may be ⅜ inch and gutter dimensions "d" and "D" may be ⅛ inch. It should be appreciated that if the embossing die 40 (FIG. 6) having uniformly spaced embossing indicia 42 is used to emboss the printed sheet 20' having offset print gutters 26', by aligning the side guide 28 of the embossing die 40 with the side guide 28 of the printed sheet 20', the resulting embossed sheet will have an array of embossed indicia 32 wherein the distance from the print gutter 26 to the embossed indicia 32 will vary between adjacent columns 14. Furthermore, using the same cutting die 50 as previously described which has die cutting gutters 52 corresponding to the print gutters 26, the resulting individual promotional cards 18 will have the same offsetting between adjacent columns as in the previously described process. The cut cards 18 can then be collated and stacked using the same stripping blanking system as previously described.

Figure 9:
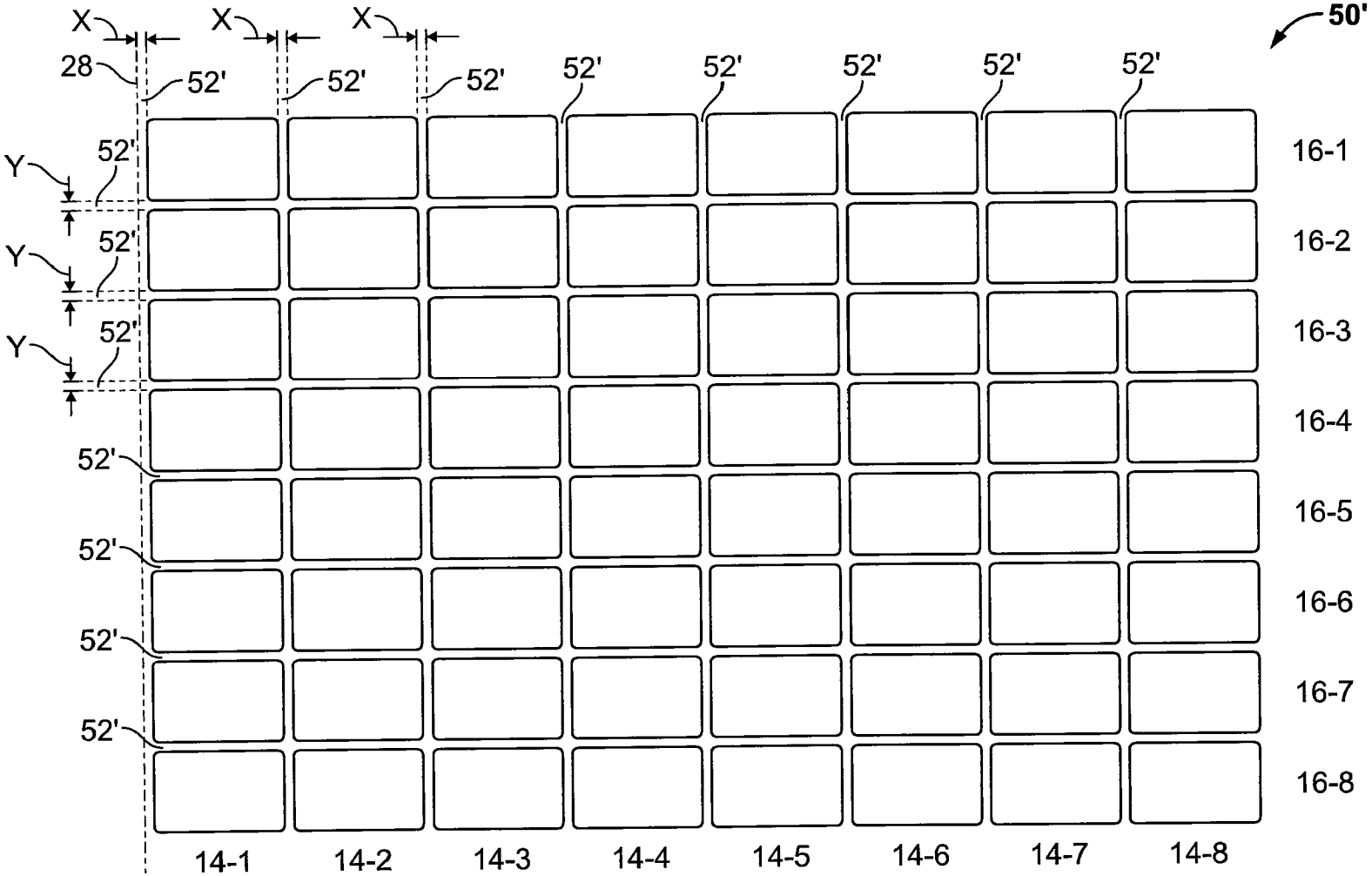
FIG. 9 is a plan view of another embodiment of a cutting die for cutting the embossed sheet of FIG. 4, wherein the cutting die gutters are shown in alignment with the print gutters of the embossed sheet.

A third alternative process for producing promotional cards is hereinafter described. In the third alternative process, a printed card sheet 20 (FIGS. 2 and 3) is produced as previously described wherein the print gutters 26 are uniform between adjacent columns (14-1 through 14-8). Additionally, an embossing die 40 (FIG. 6) having uniformly spaced embossing indicia 42 between adjacent columns is used to produce an embossed sheet 30 as previously described wherein the embossed indicia 32 is uniform between adjacent columns (14-1 through 14-8). However, unlike the previously described cutting die 50 of FIG. 7 (which has offset cutting die gutters 52), the cutting die 50' of FIG. 9 used in this third alternative method has cutting die gutters 52' that are uniform between adjacent columns (14-1 through 14-8) and correspond to the print gutters 26 of the embossed sheet 30 of FIG. 3. The same stripping, blanking and collating process as described above with the other two methods may be used for this third alternative method.

Under this third alternative method, it should be understood that the embossed indicia 32 on each of the cards 18 will be aligned when stacked (as opposed to offset as it has been in the other alternative methods). Therefore, in order to minimize the occurrence of nesting between adjacently stacked embossed promotional cards, under this third alternative method, the embossed indicia is varied between adjacent columns as hereinafter described. Thus, after the cards are embossed, the individual embossed cards are cut from the sheet and collated prior to stacking such that every other card has at least one segment of embossed indicia that differs from the embossed indicia of the preceding and subsequent stacked cards.

For example, as previously discussed, in the embodiment of the embossed sheet 30 of FIG. 4, the embossed indicia 32 comprises four segments (32*a*, 32*b*, 32*c*, 32*d*). These four segments comprising the embossed indicia 32 are varied between adjacent columns (14-1 through 14-8) so as to minimize the occurrence of nesting. For example, if the four segments 32*a*, 32*b*, 32*c*, 32*d* in the first, third, fifth and seventh columns 14-1, 14-3, 14-5, 14-7 comprised the simulated account number—1234 5678 9012 3456 the corresponding segments in the second, fourth, sixth and eighth columns 14-2, 14-4, 14-6, 14-8 could be 5678 5678 9012 3456. Thus, in accordance with this example only the first segment 32*a* of the embossed indicia 32 is varied. Of course, it should be recognized that the more the corresponding segments vary from the adjacent column, the less likely adjacent cards are to nest when stacked. For example, if all the embossed indicia for each of the segments 32*a*, 32*b*, 32*c*, 32*d* in the first, third, fifth and seventh columns is varied from the corresponding segments in the second, fourth, sixth and eighth column, it is even less likely that the cards will nest than if only one segment or two segments were varied. Varying only one or two segments, however, may prove sufficient to avoid nesting of the cards 18 when stacked.

It should be appreciated that the foregoing described alternative third method could be combined with the previously described first or second methods.

It should also be understood that reference to the term column 14 and row 16 in any of the foregoing described methods is interchangeable depending on the orientation of the sheet 10, 20, 30 or die 40, 50 and/or the orientation of the cards. Thus, the present invention should not be construed as being limited to the orientation of the sheets and cards as illustrated in the drawing figures. For example if the side guide 28 of the sheet 20 was oriented along the top side of the sheet (i.e. along the long side of the cards) as opposed to the left side of the sheet, the offsetting of the gutters would between adjacent rows 16 as opposed to adjacent columns 14.

The foregoing description is presented to enable one of ordinary skill in the art to make and use the invention and is provided in the context of a patent application and its requirements. Various modifications to the embodiments of the apparatus, methods and the general principles and features described herein will be readily apparent to those of ordinary skill in the art. Thus, the present invention is not to be limited to the embodiments described herein and illustrated in the drawing figures, but is to be accorded its widest scope consistent with the spirit and scope of the appended claims.

The invention claimed is:

1. A method of producing embossed promotional cards, the method comprising the steps of:

embossing a printed sheet with embossed indicia arranged in an array comprising a predetermined number of columns and rows, the printed sheet having an array of graphics comprising card images arranged in the same predetermined number of columns and rows as said array of embossed indicia, each card image within the array of graphics defined by a print gutter, said print gutter between adjacent columns of the array of graphics being substantially uniform, said embossed indicia in each column of said array of embossed indicia positioned at a substantially uniform distance "X" from said print gutter;

cutting said embossed sheet with a cutting die to produce individual cards, each of said individual cards having a side edge, said cutting die having a corresponding number of columns and rows as said array of graphics and said array of embossed indicia, said cutting die having cutting die gutters between adjacent columns which vary in width such that said embossed indicia on said individual cards within one of said columns begins at a different distance from said side edge on said individual cards of an adjacent one of said columns;

stripping said embossed sheet from said individual cut cards and collating said individual cut cards in a stack with said side edges substantially aligned whereby one of said individual cut cards from one of said rows is stacked adjacent to another one of said individual cut cards within that same row from an adjacent column such that said embossed indicia of said one of said individual cut cards is offset from said embossed indicia of said another one of said individual cut cards.

2. The method of claim 1 wherein said embossed indicia is the same across all columns and rows of said array of embossed indicia.

3. The method of claim 1 wherein at least a portion of said embossed indicia varies between adjacent columns of said array of embossed indicia.

* * * * *